US008096841B2

(12) United States Patent
Hirano

(10) Patent No.: US 8,096,841 B2
(45) Date of Patent: Jan. 17, 2012

(54) CONNECTOR

(75) Inventor: Shinji Hirano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/004,181

(22) Filed: Jan. 11, 2011

(65) Prior Publication Data

US 2011/0183551 A1 Jul. 28, 2011

(30) Foreign Application Priority Data

Jan. 22, 2010 (JP) ..... 2010-012068

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS

| | | | | | |
|---|---|---|---|---|---|
| 5,252,096 | A | * | 10/1993 | Okada | 439/752 |
| 5,358,427 | A | * | 10/1994 | Miwa | 439/595 |
| 5,474,477 | A | * | 12/1995 | Aoyama | 439/752 |
| 5,595,509 | A | * | 1/1997 | Fry et al. | 439/752 |
| 5,743,761 | A | * | 4/1998 | Kawase | 439/595 |
| 5,848,919 | A | | 12/1998 | Nagano | |
| 6,115,915 | A | * | 9/2000 | Kawase | 29/881 |
| 6,358,102 | B1 | * | 3/2002 | Fukamachi | 439/752 |
| 6,435,919 | B1 | * | 8/2002 | Saka et al. | 439/752 |
| 6,616,481 | B2 | * | 9/2003 | Ichio | 439/595 |
| 6,702,626 | B2 | * | 3/2004 | Ichio | 439/752 |
| 6,878,018 | B2 | * | 4/2005 | Miyakawa et al. | 439/752 |
| 7,014,512 | B2 | * | 3/2006 | Mase et al. | 439/752 |
| 7,261,603 | B2 | | 8/2007 | Takahashi et al. | |
| 2006/0046581 | A1 | | 3/2006 | Okamoto et al. | |
| 2008/0261425 | A1 | | 10/2008 | Nakamura | |
| 2008/0261438 | A1 | | 10/2008 | Nakamura | |

FOREIGN PATENT DOCUMENTS

JP 2008-243692 10/2008

* cited by examiner

*Primary Examiner* — Tulsidas C Patel
*Assistant Examiner* — Harshad Patel
(74) *Attorney, Agent, or Firm* — Gerald E. Hespos; Michael J. Porco

(57) ABSTRACT

A connector has a housing (11) with terminal accommodating chambers (12) for receiving terminal fittings (25). A retainer mount opening (15) extends into one surface of the housing (10) and receives a retainer (30) for locking the terminal fittings (25) in the terminal accommodating chambers (12). Cutouts (16) extend from an opening edge of the retainer mount opening (15) into adjacent side surfaces of the housing (11) and form jig insertion openings (20) that can receive jigs (50) for detaching the retainer (30). The retainer (30) includes blocking walls (33) for blocking flow paths from the jig insertion openings (20) into terminal accommodating chambers (12), thereby preventing foreign substances from entering the terminal accommodating chambers (12) and causing a short circuit.

17 Claims, 12 Drawing Sheets

CONNECTOR

BACKGROUND OF THE INVENTION

1. Field of the Invention

The invention relates to a connector provided with a retainer for retaining terminal fittings.

2. Description of the Related Art

Japanese Unexamined Patent Publication No. 2008-243692 discloses a connector with a housing that has terminal accommodating chambers that are separated laterally by partition walls. Terminal fittings are inserted from behind into the respective terminal accommodating chambers. A retainer mount opening is formed in an outer wall of the housing and communicates with the terminal accommodating chambers. A retainer is inserted into the retainer mount opening and has locking projections that engage steps on the terminal fittings to restrict movement of the terminal fittings in a withdrawing direction. A jig insertion opening is formed at an edge of the retainer and can receive a jig for detaching the retainer. The jig insertion opening is formed over a plurality of terminal accommodating chambers and a small clearance may be formed between the jig insertion opening and the retainer mount opening due to an assembling error.

The above-described connector may be used in oil, such as lubricating oil. Foreign substances, such as iron powder, may be suspended in this oil and could easily enter the terminal accommodating chambers through the clearance between the jig insertion opening and the retainer mount opening. The clearance formed by the jig insertion opening extends over the plurality of terminal accommodating chambers. Hence, foreign substances that enter this clearance can deposit over the plurality of terminal fittings to cause a short circuit. Clearances between the retainer and the partition walls that separate the terminal accommodating chambers have a linear cross section. Thus, creepage distances between the terminal fittings are linear and short, thereby increasing the chance of a short circuit caused by foreign substances that have entered the terminal accommodating chambers and deposited over the terminal fittings.

U.S. Pat. No. 7,261,603 discloses a connector that attempts to solve the above-described problems. The connector of U.S. Pat. No. 7,261,603 has one jig insertion opening that communicates with one terminal accommodating chamber for one terminal fitting. A closure is provided for separating the terminal accommodating chamber that communicates with the jig insertion opening from another terminal accommodating chamber. Accordingly, a short circuit is less likely to be caused by deposition of foreign substances over the terminal accommodating chamber that communicates with the jig insertion opening and the other terminal accommodating chamber. However, foreign substances easily enter the terminal accommodating chamber and accumulate since the jig insertion opening communicates with one terminal accommodating chamber. Thus, a short circuit between the terminal fittings can be created through a clearance between a partition wall and a retainer.

The invention was developed in view of the above situation and an object thereof is to improve operability particularly by preventing a contact with a terminal fitting and/or a short circuit between terminal fittings caused by entered foreign substances.

SUMMARY OF THE INVENTION

The invention relates to a connector with a housing that has at least one terminal accommodating chamber for accommodating at least one terminal fitting. A retainer mount opening is formed in an outer wall and communicates with the terminal accommodating chamber. A retainer is mounted detachably into the housing to close the retainer mount opening. The retainer has at least one terminal lock for engaging the terminal fitting and preventing the terminal fitting from being withdrawn from the terminal accommodating chamber. At least one cutout extends from an opening edge of the retainer mount opening to an adjacent side surface. At least one jig insertion opening is formed in a side surface adjacent to the surface that has the retainer mount opening. The jig insertion opening can receive a jig for detaching the retainer. The retainer includes at least one blocking wall that is at least partly interposed between the terminal accommodating chamber and the jig insertion opening for blocking a flow path from the jig insertion opening into the terminal accommodating chamber.

The housing preferably has a plurality of terminal accommodating chambers arranged substantially side by side and at least partly partitioned by a partition wall. The retainer mount opening is formed in the surface of the outer wall extending substantially in an arrangement direction of the terminal accommodating chambers.

The jig insertion opening is formed in a surface adjacent and orthogonal to the surface that has the retainer mount opening and accordingly the jig insertion opening does not extend over a plurality of terminal accommodating chambers. Thus, foreign substances are not likely to enter the jig insertion opening and become deposited over a plurality of terminal accommodating chambers. Further, the blocking wall of the retainer blocks the flow path from the jig insertion opening into the terminal accommodating chamber at a side of the jig insertion opening toward the terminal accommodating chamber. Thus, foreign substances will not enter the terminal accommodating chambers through the jig insertion opening. As a result, a large amount of foreign substances will not accumulate in the terminal accommodating chambers and consequently short circuits will not be caused by the deposition of foreign substances over the terminal fittings.

The retainer preferably has plural locking pieces for locking the retainer in the retainer mount opening. The blocking wall preferably is between two locking pieces juxtaposed in a direction parallel with an inserting direction of the terminal fittings. A projecting height of the blocking wall preferably is equal to projecting heights of the locking pieces. The blocking wall blocks the flow path from the jig insertion opening into the terminal accommodating chamber. However, a small clearance unavoidably is formed between the retainer mount opening and the retainer due to an assembling error and, hence, it is difficult for the blocking wall to close the jig insertion opening completely. A distance from the jig insertion opening to the terminal accommodating chamber may be extended as much as possible for maximally preventing foreign substances that enter a clearance between the retainer mount opening and the blocking wall from reaching the interior of the terminal accommodating chamber. Accordingly, the projecting height of the blocking wall preferably equals projecting heights of the locking pieces.

Two jig insertion openings may be formed at substantially opposite ends of the retainer and detaching jigs can be inserted into the respective jig insertion openings for easily detaching the retainer while being sandwiched by the respective detaching jigs.

A short circuit caused by a deposit of foreign substances over the terminal fittings could occur at the jig insertion opening or in a clearance between the retainer and the partition wall that separates the terminal fittings. Accordingly, the partition wall preferably has a height to be held in contact with the retainer and the retainer preferably has a fitting portion for receiving a projecting end of the partition wall. Thus, even if a clearance is formed between the partition wall and the retainer, a long creepage distance between the terminal fittings substantially prevents foreign substances from causing a short circuit between the terminal fittings.

The terminal fittings preferably are female terminal fittings and each has a tube at its leading end. The partition wall in the retainer mount opening includes front, rear and intermediate parts. A projecting end of the front part of the partition wall is substantially flush with an outer surface of the housing where the retainer mount opening is formed. The rear part of the partition wall extends back from the rear ends of the tubes of the female terminal fittings. The intermediate part of the partition wall is behind and continuous with the front part. A fitting groove preferably is formed in a front edge of the retainer for receiving the front part of the partition wall, and a fitting portion is formed in a surface of the retainer facing the terminal accommodating chambers for receiving a projecting end of the intermediate part of the partition wall. The extension of the rear end of the front partition wall rearward of the tubes of the terminal fittings creates a long creepage distance between the tubes of the adjacent terminal fittings and improves insulation performance.

At least one hook preferably projects from each of opposite ends of the retainer in the arrangement direction of the terminal accommodating chambers and fits into the cutout to close a side toward the surface with the retainer mount opening.

The blocking wall preferably is arranged along the interior side of a lateral wall of the housing when the retainer is mounted into the retainer mount opening.

These and other objects, features and advantages of the invention will become more apparent upon reading the following detailed description of preferred embodiments and accompanying drawings. It should be understood that even though embodiments are described separately, single features may be combined to additional embodiments.

DETAILED DESCRIPTION OF THE PREFERRED EMBODIMENTS

Figure 1:
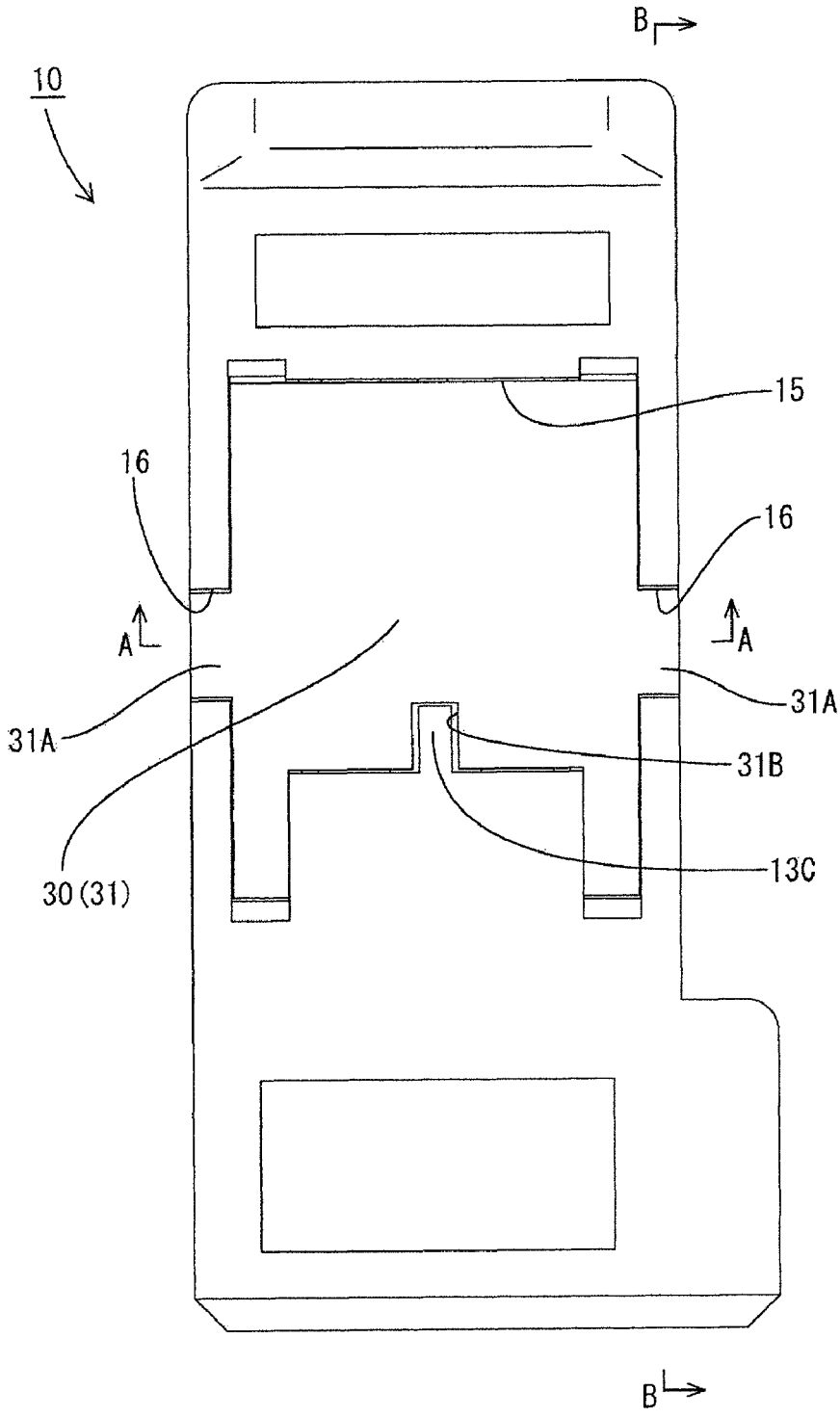
FIG. 1 is a top view of a connector in accordance with the invention.

A connector in accordance with one embodiment of the invention is identified by the numeral 10 in FIGS. 1 to 7. The connector 10 has a substantially block-shaped housing 11 made e.g. of synthetic resin, a retainer 30 and female terminal fittings 25. In the following description, upper and lower ends of FIG. 1 are referred to as rear and front ends, a surface of the connector 10 where the retainer 30 is mounted is referred to as an upper surface and a lateral direction is referred to as a width direction.

Figure 2:
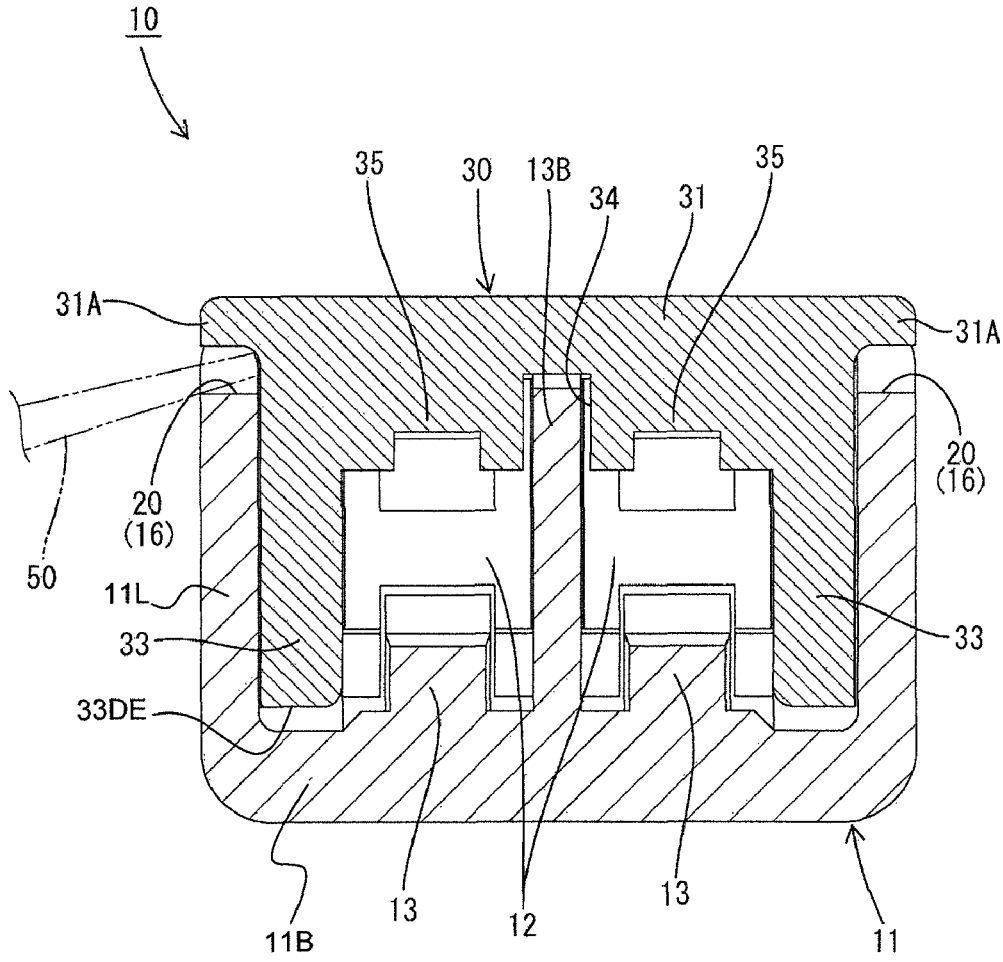
FIG. 2 is a section along A-A of FIG. 1.
Figure 6:
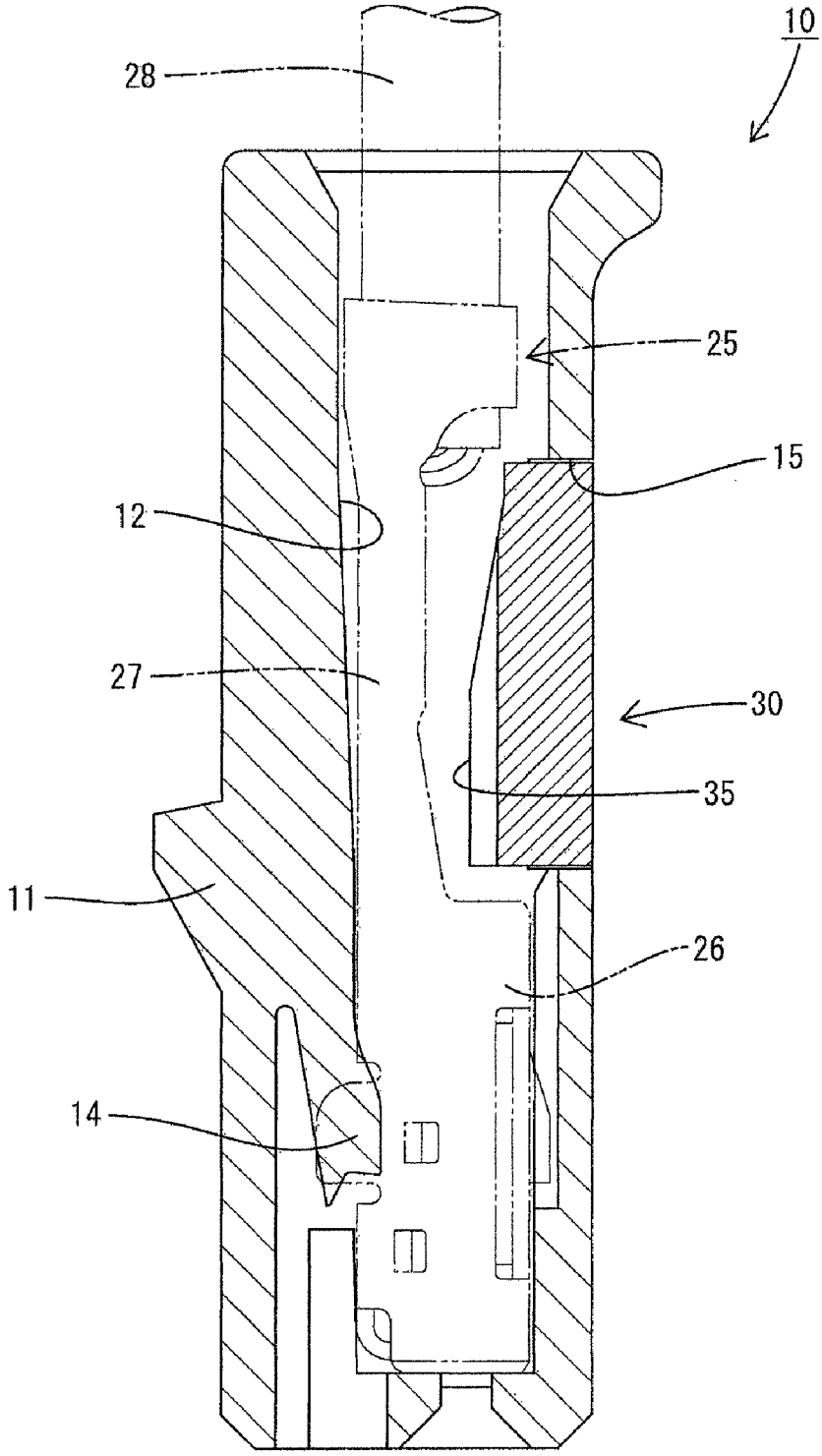
FIG. 6 is a section along C-C of FIG. 5.
Figure 8:
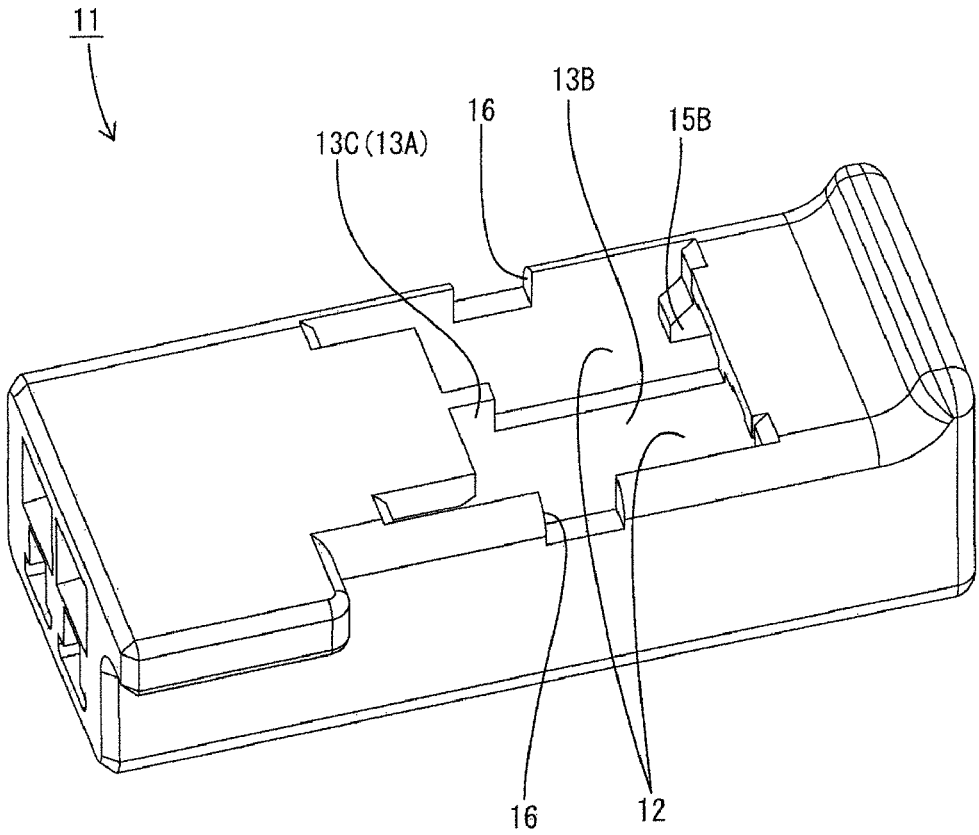
FIG. 8 is a perspective view of the housing of the connector.

Two cavities 12 penetrate the housing 11 in forward and backward directions and are arranged substantially side by side in the width direction, as shown in FIGS. 2, 6 and 8, to define terminal accommodating chambers. The housing 11 has a bottom wall 11B and a partition wall 13 extends vertically up from the bottom wall 11B to partition the two cavities 12. The partition wall 13 includes a front part 13A, an intermediate part 13B and a rear part (not shown). The front part 13A of the partition wall 13 is adjacent the front of the housing 11 and is continuous with an upper wall of the housing 11. The intermediate part 13B of the partition wall 13 is behind the front part 13A and has its upper surface exposed by a retainer mount opening 15. The rear part of the partition wall 13 is at a rear side of the retainer mount opening 15 and, similar to the front part 13A, is continuous with the upper wall of the housing 11. Two locking lances 14 are formed unitarily with the housing 11 and are cantilevered forward along a bottom wall of each respective cavity 12, as shown in FIG. 6.

Each female terminal fitting 25 has a known form with a substantially rectangular tube 26 at a front end and a wire crimping portion 27 that extends back from the rear end of the tube 26. An unillustrated resilient contact piece is provided in the rectangular tube 26 and a wire 28 is connected to the wire crimping portion 27. The female terminal fitting 25 is inserted into the cavity 12 from behind the housing 11, and is engaged and retained by the locking lance 14 at a proper insertion position. The wire 28 connected to the female terminal fitting 25 is drawn out to the back of the housing 11.

Figure 3:
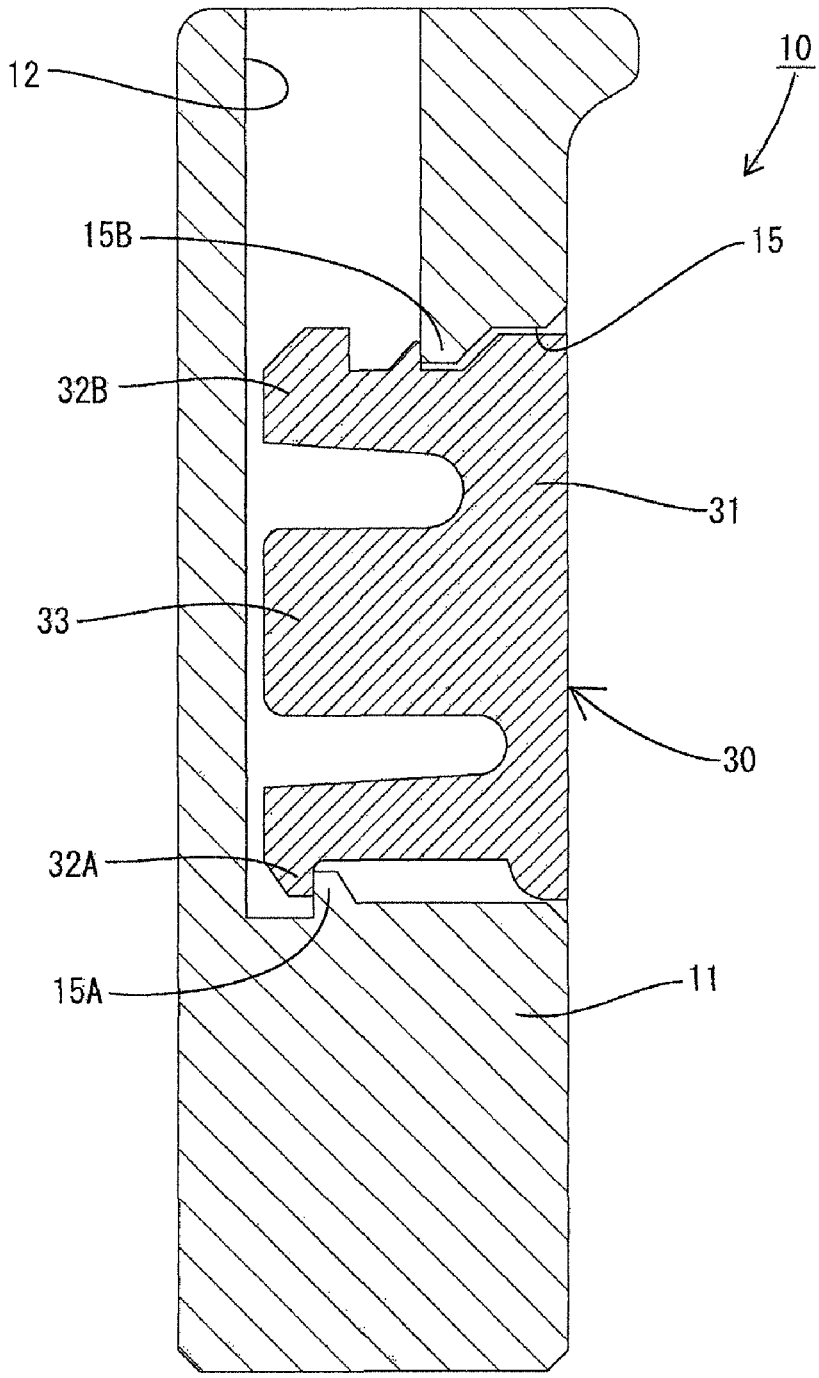
FIG. 3 is a section along B-B of FIG. 1.
Figure 7:
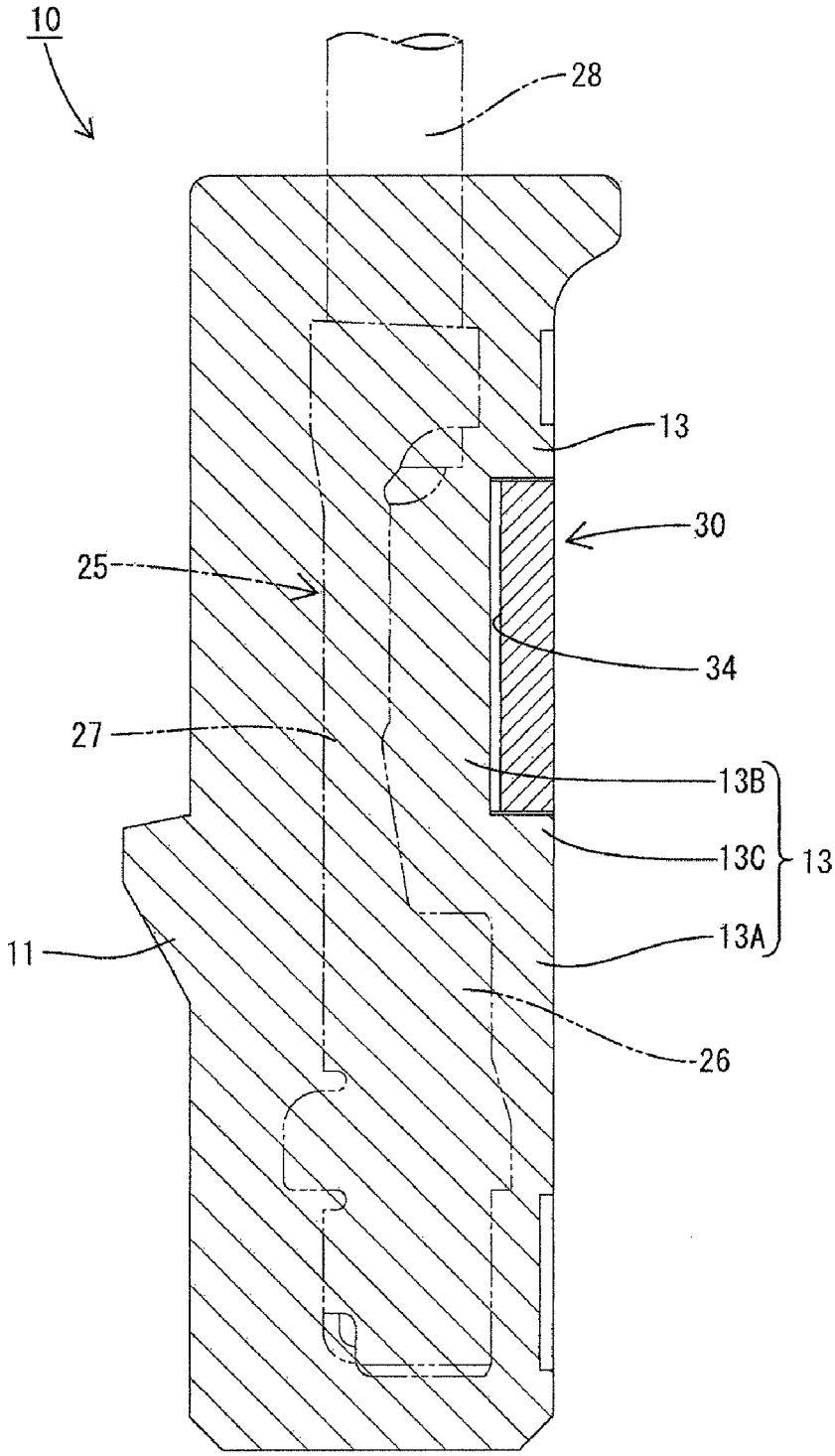
FIG. 7 is a section along D-D of FIG. 5.

The retainer mount opening 15 is formed in the upper surface of the housing 11 communicates with the two cavities 12. The front part 13A of the partition wall 13 projects back from a front opening edge of the retainer mount opening 15, as shown in FIG. 8, and defines a projecting wall 13C. The rear end of the projecting wall portion 13C is located sufficiently backward from the rear ends of the rectangular tubes 26 of the female terminal fittings 25, as shown in FIG. 7, so that a creepage distance between the respective rectangular tubes 26 of the two female terminal fittings 25 is long enough to ensure a sufficient insulation performance. As shown in FIG. 3, two front locks 15A and two rear locks 15B are provided at inner peripheral edges of the retainer mount opening 15 and engage the retainer 30 as described below. The locks 15A, 15B double as inner walls of the cavities 12.

Figure 4:
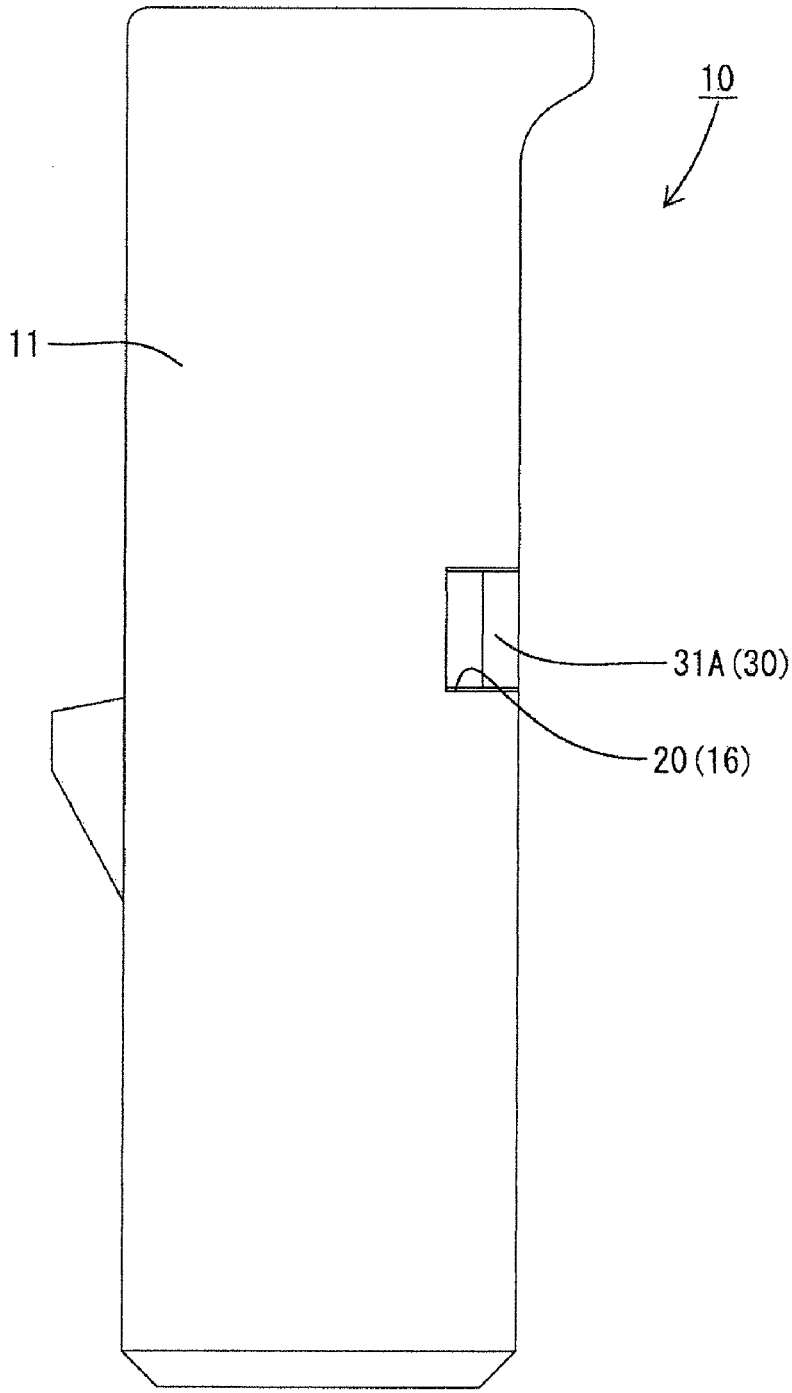
FIG. 4 is a side view of the connector.
Figure 5:
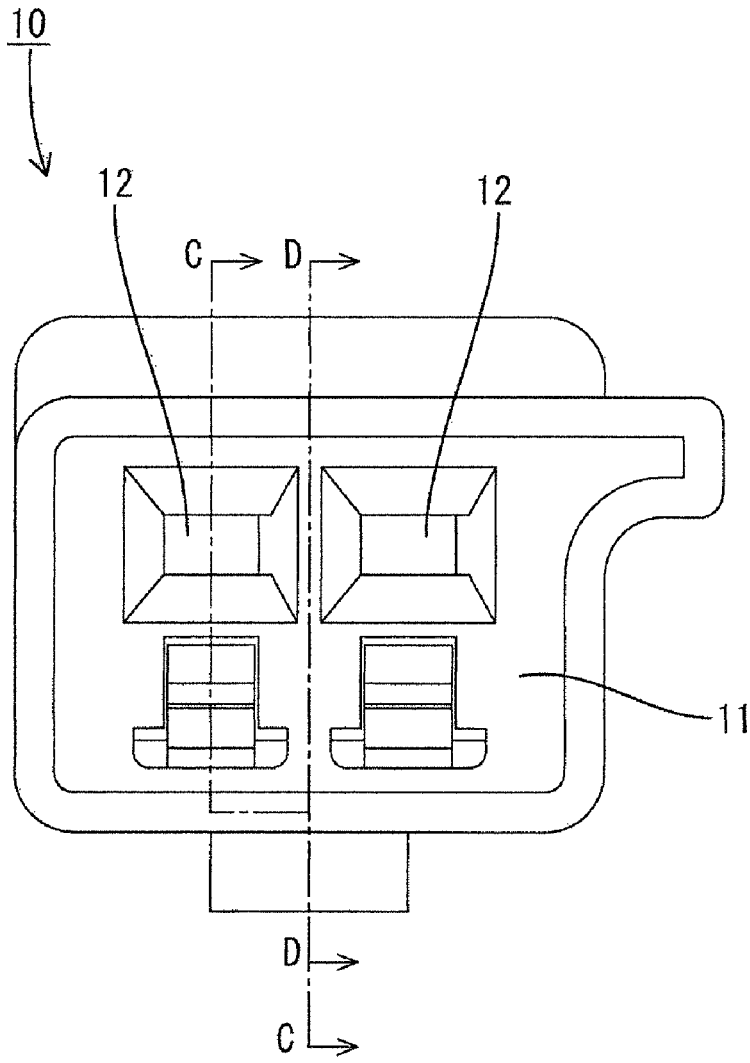
FIG. 5 is a front view of the connector.

Two groove-shaped cutouts 16 are formed at the retainer mount opening 15 and extend from left and right ends of an opening edge of the retainer mount opening 15 to adjacent lateral walls 11L of the housing 11 (see FIGS. 1 and 2). Hooks 31A project from opposite lateral portions of the retainer 30 and close upper sides of the cutouts 16 as the retainer 30 is mounted into the retainer mount opening 15. Remaining lower sides of the cutouts 16 are not closed by the retainer 30 and define jig insertion openings 20 that penetrate the respective lateral walls 11L of the housing 11 in the lateral direction as shown in FIGS. 2 and 4. Detaching jigs 50, as shown by chain double-dashed line in FIG. 2, can be inserted into the jig insertion openings 20 and push up the hooks 31A that form the upper walls of the jig insertion openings 20 so that the retainer 30 can be detached from the retainer mount opening 15.

Figure 9:
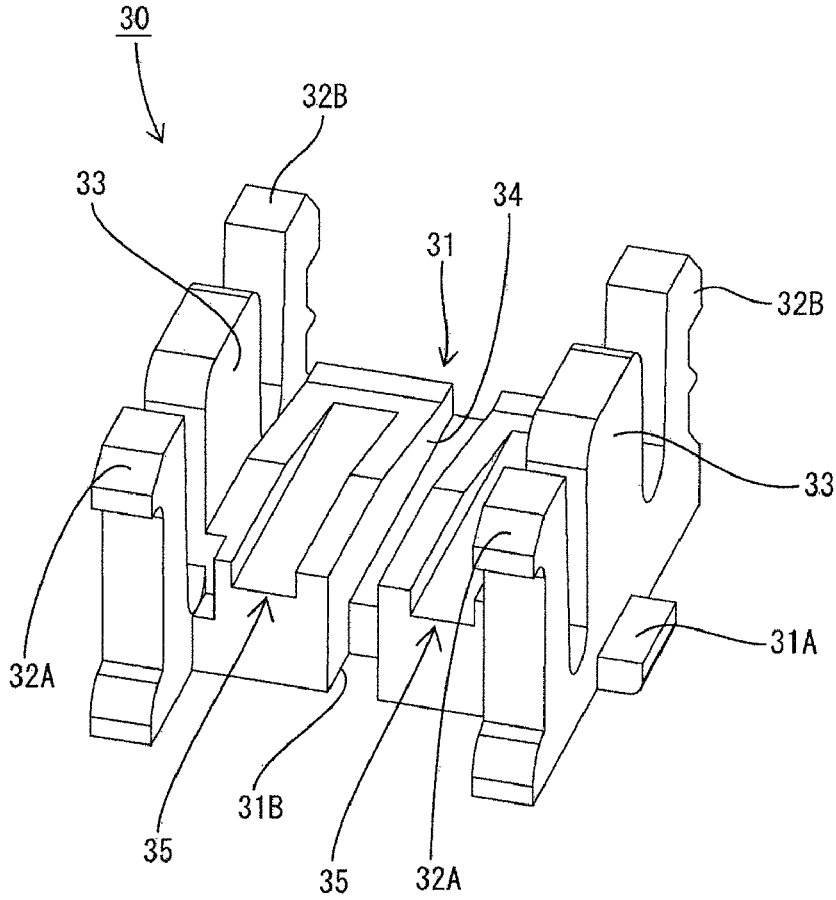
FIG. 9 is a perspective view of the retainer of the connector.
Figure 10:
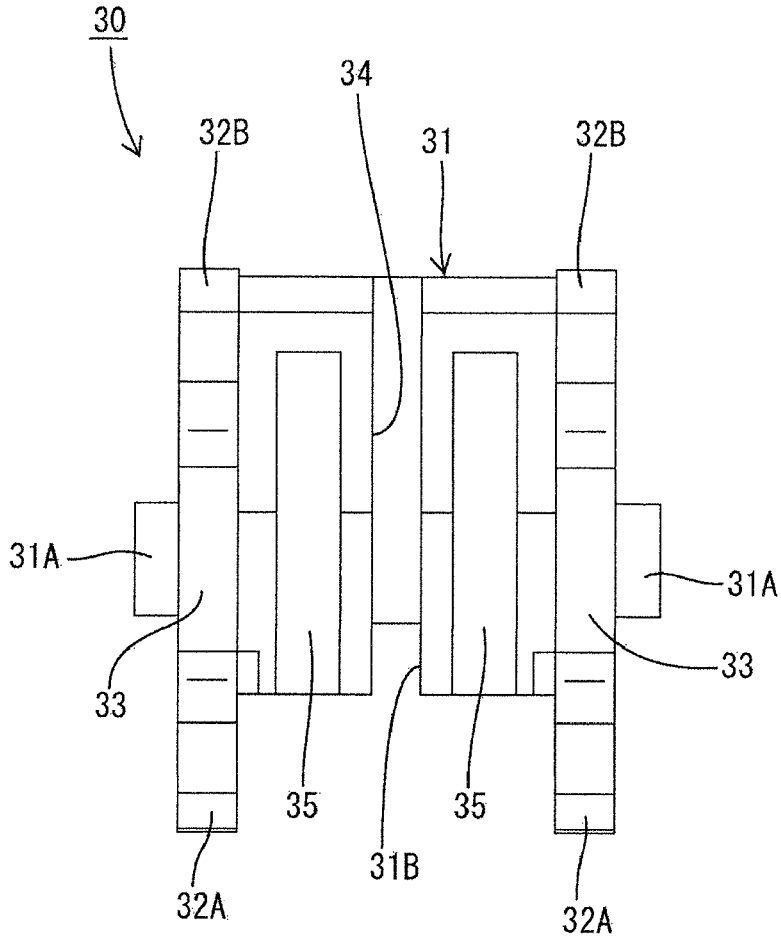
FIG. 10 is a plan view of a cavity side of the retainer.
Figure 11:
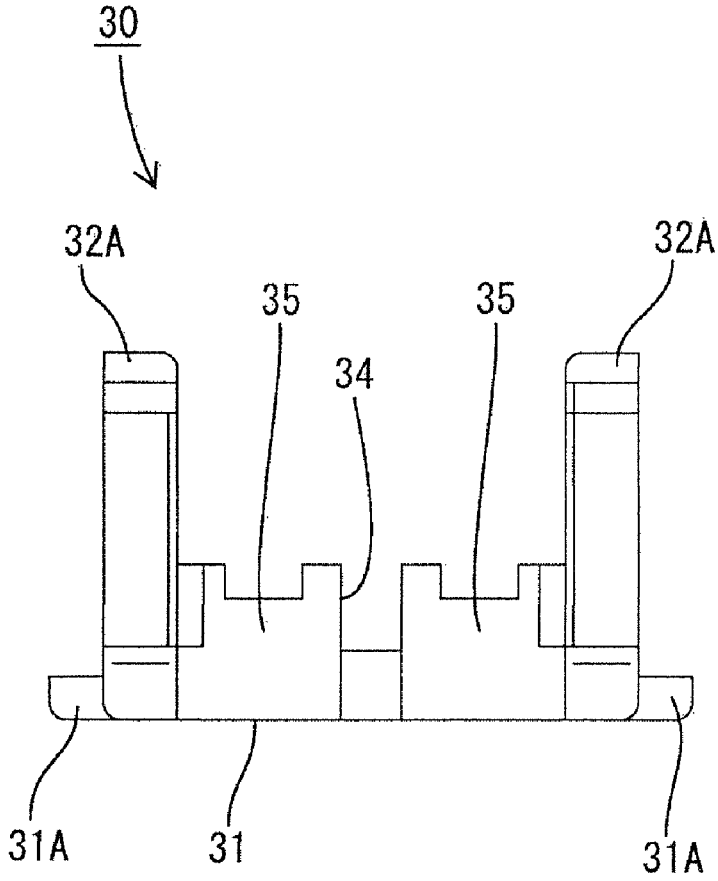
FIG. 11 is a side view of a front side of the retainer.
Figure 12:
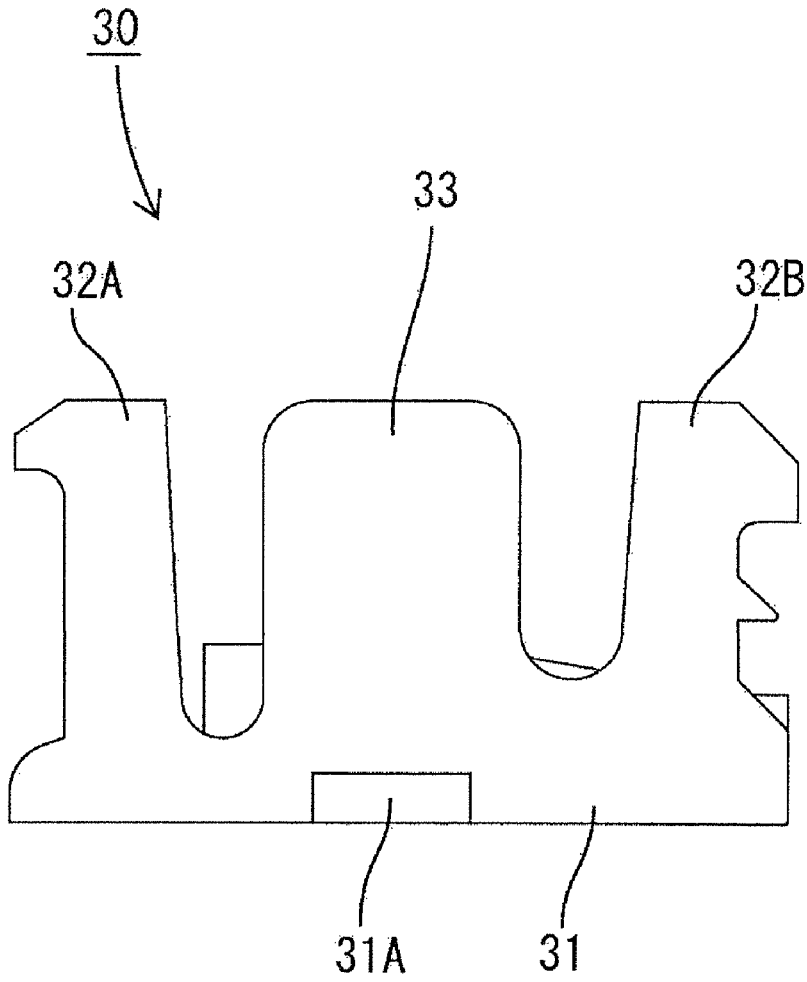
FIG. 12 is a side view of a blocking wall side of the retainer.

The retainer 30 is made unitarily e.g. of synthetic resin and includes a block-shaped main body 31 for substantially closing the retainer mount opening 15, locking pieces 32A, 32B for engaging the respective locks 15A, 15B of the retainer mount opening 15, and block walls 33 for substantially closing the jig insertion openings, as shown in FIGS. 9 to 12. The hooks 31A project out from the opposite widthwise sides of the main body 31 at substantially central positions in forward and backward directions and fit into the cutouts 16 from above. A recess 31B is formed in a front edge of the main body 31 at a substantially central position in the width direction, as shown in FIG. 9, and the projecting wall 13C of the retainer mount opening 15 is to be fit therein. A fitting groove 34 extends in forward and backward directions behind the recess 31B, and a projecting end of the intermediate part 13B of the partition wall 13 in the housing 11 is to be fit in the fitting groove 34. Terminal locks 35 are provided at the left and right sides of the fitting groove 34. The terminal locks 35 have an uneven shape and are to be fit on and engaged with the wire crimping portions 27 of the female terminal fittings 25 inserted into the cavities 12.

Two blocking walls 33 and pairs of locking pieces 32 stand at positions of the opposite widthwise sides of the main body 31 inward of the hooks 31A. The locking pieces 32 include left and right front locking pieces 32A at the front end of the main body 31 and left and right rear locking pieces 32B at the rear end. The locking pieces 32 are engageable with the corresponding front and rear locks 15A and 15B of the retainer mount opening 15.

The blocking walls 33 are formed between the front and rear locking pieces 32A, 32B at the same side of the retainer 30. Each blocking wall 33 is a flat plate and has a length so that a distal end 33DE thereof is near the bottom wall 11B (FIG. 2) of the housing 11 when the retainer 30 is mounted into the retainer mount opening 15. The blocking walls 33 are arranged along the interior side of lateral walls 11L of the housing 11 (see FIG. 2) when the retainer 30 is mounted in the retainer mount opening 15. With the retainer 30 mounted in the housing 11, each blocking wall is interposed between the jig insertion opening 20 and the cavities 12 so as to extend a creepage distance and prevent external matter from coming into contact with the terminal fitting 25 in the cavity 12. The blocking walls 33 are arranged to substantially fully cover the peripheral edges of the jig insertion openings 20 from sides toward the cavities 12 when the retainer 30 is mounted in the housing 11. The jig insertion openings 20 define a depth for the detaching jig 50 equal to the thickness of the side walls of the housing 11. However, the blocking walls 33 block or separate the cavities at the interior of the housing 11 from the jig insertion openings 20.

The retainer 30 is pushed to a locking position after the female terminal fittings 25 are inserted to proper positions. Thus, the locking pieces 32A, 32B of the retainer 30 deform toward the blocking walls 33 and then resiliently restore to engage the locks 15A, 15B so that the retainer 30 is mounted in the retainer mount opening 15. With the retainer 30 mounted in the retainer mount opening 15, the intermediate part 13B of the partition wall 13 of the housing 11 is fit into the fitting groove 34 and the partition wall 13C is fit into the recess 31B. Additionally, the terminal locks 35 are located behind and near the rectangular tubes 26 of the female terminal fittings 25 in the cavities 12. Thus, the female terminal fittings 25 are locked doubly in the cavities 12 by the retainer 30 and the locking lances 14. Further, the hooks 31A are fit into the cutouts 16 to form jig insertion openings 20 in the left and right walls 11L of the housing 11. The blocking walls 33 are at the inner sides of and along the side walls of the housing 11 including the jig insertion openings 20 to block flow paths from the jig insertion openings 20 into the cavities 12.

To detach the retainer 30 from the retainer mount opening 15, the detaching jigs 50 are inserted into the jig insertion openings 20, as shown in FIG. 2. The detaching jigs 50 inserted into the jig insertion openings 20 push up on the lower sides of the hooks 31A extending from the main body 31. Thus, the retainer 30 is deformed resiliently to disengage the locking pieces 32A, 32B from the locks 15*a*, 15B and the retainer 30 can be detached from the retainer mount opening 15.

As described above, the jig insertion openings 20 are formed in the lateral walls 11L at the opposite sides of the housing 11. However, the blocking walls 33 of the retainer 30 block and separate the jig insertion openings 20 from the cavities 12. Accordingly, foreign substances are hindered from entering the cavities 12 through the jig insertion openings 20 while ensuring the jig insertion openings 20 can be used for detaching the retainer 30. Specifically, the blocking walls 33 are arranged substantially along the peripheral edges of the jig insertion openings 20 at the inner sides of the housing 11, thereby blocking the flow paths to the cavities 12. Even if small clearances should be formed between the jig insertion openings 20 and the blocking walls 33, extending distances of the clearances are substantially equivalent to the projecting lengths of the blocking walls 33. Thus, for example, as compared with a conventional case where jig insertion openings directly communicate with the interiors of the cavities, it becomes considerably more difficult for foreign substances to enter the cavities 12 through the jig insertion openings 20, which can prevent a short circuit between the female terminal fittings 25 resulting from the entrance of foreign substances into the cavities 12.

Further, the partition wall 13 between the cavities 12 has a height to be held substantially in contact with the retainer 30. Thus, a space communicating with the cavities 12 is reduced maximally, thereby minimizing a possibility that foreign substances will deposit over the cavities 12. In addition, the intermediate part 13B of the partition wall 13 fits into the fitting groove 34 of the retainer 30 to create a longer creepage distance between the female terminal fittings 25 via the clearance formed between the intermediate part 13B of the partition wall 13 and the fitting groove 34 as compared with a conventional case where a creepage distance extends via a linear groove.

The rectangular tube 26 of the female terminal fitting 25 has a larger vertical height than other parts of the female terminal fitting 25. Thus, a creepage distance between the rectangular tubes 26 of the adjacent female terminal fittings 25 tends to be short. However, the projecting wall 13C at the front end of the retainer mount opening 15 extends the creepage distance sufficiently to improve insulation performance.

The retainer 30 can be detached easily from the retainer mount opening 15 while being sandwiched by the detaching jigs 50 in the two jig insertion openings 20 at the opposite ends of the retainer 30.

The invention is not limited to the above described embodiment. For example, the following embodiments also are included in the scope of the invention.

Jig insertion openings 20 are provided at opposite widthwise sides of the housing 11 in the above embodiment. However, the jig insertion opening 20 may be formed at only one of the sides. Reducing the number of the jig insertion openings 20 reduces the possibility of foreign substances entering through the jig insertion openings 20.

The cutouts 16 are formed in central parts of the widthwise ends of the retainer mount opening 15 in forward and backward directions in the above embodiment. However, the cutouts 16 may be formed in the entire widthwise ends of the retainer mount opening 15. With such a construction, it is not necessary to form the main body 31 of the retainer 30 with the hooks 31A (the main body 31 may extend entirely to the opposite widthwise sides) and the retainer 30 and the housing 11 can be formed more easily.

The blocking walls 33 are shaped to be held entirely held in close contact with the inner walls of the cavities 12 in the above embodiment. However, a recess that does not communicate with the cavity 12 may be formed in a part of each blocking wall 33 continuous with the jig insertion opening 20. As an example, a recessed groove that will communicate with the jig insertion opening 20 may be formed in each blocking wall 33, and a mating projection engageable with this recessed groove may be provided on the bottom wall of the housing 11. A longer insertion margin of the detaching jig 50 can be ensured in the jig inserting direction by forming the groove in the blocking wall 33, and a larger engaging margin of the detaching jig 50 with the retainer 30 can be ensured. A part of the groove near the bottom wall of the housing 11 can be closed by the projection on the housing 11. The flow path from the jig insertion opening 20 to the cavity 12 can be blocked by such a shape.

What is claimed is:

1. A connector, comprising:

a housing with at least one terminal accommodating chamber for accommodating at least one terminal fitting and a retainer mount opening formed in an outer surface and communicating with the terminal accommodating chamber, at least one cutout extending from an opening edge of the retainer mount opening to an adjacent side surface of the housing; and a retainer detachably mounted into the housing and substantially closing the retainer mount opening, the retainer including at least one terminal lock engaging the terminal fitting and preventing the terminal fitting from being withdrawn from the terminal accommodating chamber, the retainer being disposed relative to the cutout to define at least one jig insertion opening formed in the side surface of the housing adjacent the surface with the retainer mount opening, the jig insertion opening being enclosed by the retainer mounted in the housing and the cutout, the retainer including at least one blocking wall at least partly interposed between the terminal accommodating chamber and the jig insertion opening for blocking a flow path from the jig insertion opening into the terminal accommodating chamber.

2. The connector of claim 1, wherein the at least one terminal accommodating chamber comprises at least two substantially side by side terminal accommodating chambers at least partly partitioned by a partition wall, the surface of the housing having the retainer mount opening extending substantially in an arrangement direction of the terminal accommodating chambers.

3. The connector of claim 2, wherein:

the retainer includes a plurality of locking pieces for locking the retainer in the retainer mount opening; and the blocking wall is arranged between a pair of locking pieces juxtaposed in a direction parallel with an inserting direction of the terminal fitting.

4. The connector of claim 3, wherein a projecting height of the blocking wall is substantially equal to projecting heights of the locking pieces.

5. The connector of claim 2, wherein a pair of jig insertion openings are formed in correspondence with substantially opposite ends of the retainer.

6. The connector of claim 2, wherein:

the partition wall of the housing has such a height to be held in contact with the retainer, and the retainer is formed with a fitting portion that receives a projecting end of the partition wall.

7. The connector of claim 2, wherein:

the terminal fittings are female terminal fittings each including a tube at a leading end side, and the partition wall in the retainer mount opening includes a front part with a projecting end substantially flush with an outer surface of the housing where the retainer mount opening is formed, a rear end of the front part of the partition wall extending back beyond rear ends of the tubes of the female terminal fittings, the partition wall further having an intermediate part behind and continuous with the front part

8. The connector of claim 7, wherein the retainer has a fitting groove for receiving the front part of the partition wall, and a fitting portion for receiving a projecting end of the intermediate part of the partition wall

9. The connector of claim 2, wherein hooks project from opposite ends of the retainer in the arrangement direction of the terminal accommodating chambers and is fit into the cutout to close a side toward the surface where the retainer mount opening is formed.

10. The connector of claim 2, wherein the blocking wall is arranged substantially along an interior side of a lateral wall of the housing when the retainer is mounted into the retainer mount opening.

11. A connector, comprising:

a housing with opposite front and rear ends, opposite first and second side walls extending between the front and rear ends and a top wall extending between the side walls, first and second terminal accommodating chambers arranged side by side between the first and second side walls and extending between the front and rear ends, a retainer mount opening formed in the top wall and communicating with the terminal accommodating chambers (12), first and second cutouts (16) formed respectively in the first and second side walls and adjacent to opening edges of the retainer mount opening in the top wall; and a retainer detachably mounted in the retainer mount opening and bridging the cutouts to define jig insertion openings between the retainer and portions of the side walls having the cutouts, the retainer including first and second blocking walls interposed between the respective first and second terminal accommodating chambers and the jig insertion openings for blocking a flow path from the jig insertion opening into the terminal accommodating chamber.

12. The connector of claim 11, wherein the retainer includes locking pieces forward and rearward of the respective blocking walls for locking the retainer in the retainer mount opening.

13. The connector of claim 11, further comprising a partition wall between the terminal accommodating chambers.

14. The connector of claim 13, wherein the partition wall of the housing has a height to be held in contact with the retainer, and the retainer is formed with a fitting groove that receives a projecting end of the partition wall.

15. The connector of claim 13, further comprising first and second terminal fittings mounted respectively in the first and second terminal accommodating chambers, the retainer including first and second terminal locks engaging and locking the first and second terminal fitting respectively.

16. The connector of claim 15, wherein:

the terminal fittings are female terminal fittings, each female terminal fittings including a tube at a leading end, and the partition wall in the retainer mount opening including a front part with a projecting end substantially flush with an outer surface of the housing where the retainer mount opening is formed, a rear end of the front part of the partition wall extending back beyond rear ends of the tubes of the female terminal fittings, the partition wall further having an intermediate part behind and continuous with the front part.

17. The connector of claim 16, wherein the retainer has a fitting groove for receiving the front part of the partition wall, and a fitting portion for receiving a projecting end of the intermediate part of the partition wall.

* * * * *